US006565463B2

(12) United States Patent
Pai

(10) Patent No.: US 6,565,463 B2
(45) Date of Patent: May 20, 2003

(54) SHOCK-ABSORBING RACKET BODY

(76) Inventor: Chin-Dong Pai, 20-3 Fl., No. 123, Sec. 3, Jonggang Rd., Taichung (TW)

( * ) Notice: Subject to any disclaimer, the term of this patent is extended or adjusted under 35 U.S.C. 154(b) by 0 days.

(21) Appl. No.: 10/054,564

(22) Filed: Jan. 22, 2002

(65) Prior Publication Data

US 2003/0060312 A1 Mar. 27, 2003

(30) Foreign Application Priority Data

Sep. 25, 2001 (CN) ..... 01263018 U

(51) Int. Cl.[7] ..... A63B 49/02
(52) U.S. Cl. ..... 473/521
(58) Field of Search ..... 473/520, 521, 473/524

(56) References Cited

U.S. PATENT DOCUMENTS 4,353,551 A * 10/1982 Arieh et al. ..... 473/521
4,772,021 A * 9/1988 Maynard ..... 473/521
4,948,131 A * 8/1990 Nakanishi ..... 273/DIG. 29
4,983,242 A * 1/1991 Reed ..... 156/172
5,039,096 A * 8/1991 Chen ..... 473/521
5,100,136 A * 3/1992 Chen ..... 473/519
5,242,724 A * 9/1993 You ..... 473/521
5,314,180 A * 5/1994 Yamagishi et al. ..... 473/520
5,409,215 A * 4/1995 You ..... 473/521
5,524,884 A * 6/1996 Haines ..... 473/520
5,860,878 A * 1/1999 You ..... 473/520

FOREIGN PATENT DOCUMENTS

EP 523913 * 1/1993 ..... 473/FOR 171
WO 94/28980 * 12/1994 ..... 473/FOR 181

* cited by examiner

*Primary Examiner*—Raleigh W. Chiu
(74) *Attorney, Agent, or Firm*—Jackson Walker L.L.P.

(57) ABSTRACT

A shock-absorbing racket body is comprised of the conventional body elements including an elliptical frame, a Y-shaped throat, a shaft and a handle and at least one slit defined one or a combination of the conventional body elements to receive a shock-absorbing device to absorb the reactive force generated when striking a ball. The absorbing device is provided to absorb the reactive force when striking a ball and to damp and attenuate resonant vibration after striking a ball to prevent injury to the player's wrist.

8 Claims, 9 Drawing Sheets

SHOCK-ABSORBING RACKET BODY

BACKGROUND OF THE INVENTION

1. Field of the Invention

The present invention relates to a racket body, and more particularly to a racket body that has a shock-absorbing device.

2. Description of Related Art

With reference to FIGS. 8 and 9, a conventional racket body (50) in accordance with the prior art comprises a frame (51), an Y-shaped throat (52) a shaft (53) and a handle (54) integrally formed in one plane. There is no absorbing device attached to the racket (50) so that sport's injuries to a player's wrist are usually incurred as a result of reactive forces generated when striking a ball. Furthermore, a resonant vibration is generated in the racket after striking a ball and needs time to attenuate due to the reactive force. The resonant vibration is transmitted to the player's hand and injures the player's wrist before the resonant vibration fully attenuates.

The present invention has arisen to mitigate and/or obviate the disadvantages of the main structure of a conventional racket.

SUMMARY OF THE INVENTION

The main objective of the present invention is to provide an improved racket body that will absorb a significant amount of the reactive force generated when the racket strikes a ball and reduce the resonant vibration after the racket strikes a ball.

To achieve the objective, the racket body in accordance with the present invention comprises an elliptical frame, a Y-shaped throat, a shaft a handle and a shock-absorbing device. The Y-shaped throat integrally extends from the frame. The shaft has two ends with one end integrally formed with the throat and a free end. The handle is formed on the free end of the shaft. The shock-absorbing device is mounted in the racket body, such as the frame, the throat or the shaft to absorb the reactive force and reduce the resonant vibration when using the racket.

Further benefits and advantages of the present invention will become apparent after a careful reading of the detailed description with appropriate reference to the accompanying drawings.

DETAILED DESCRIPTION OF THE INVENTION

Figure 1:
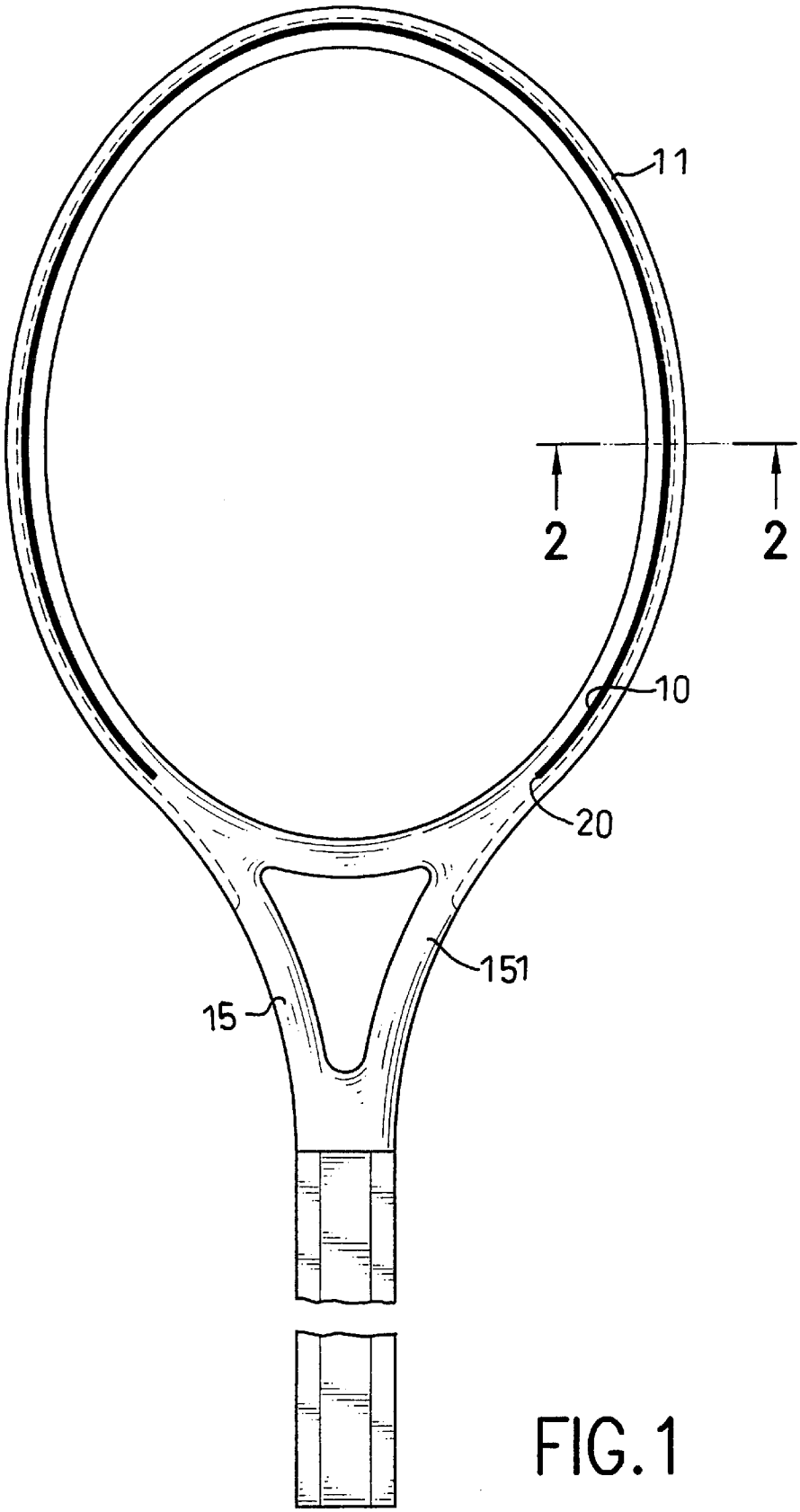
FIG. 1 is a front plan view of a shock-absorbing racket body in accordance with the present invention.

With reference to the drawings and initially to FIG. 1, a shock-absorbing racket body in accordance with the present invention comprises an elliptical frame (11), a Y-shaped throat (15) with two arms (151) respectively integrally connected to the elliptical frame (11), a shaft (12) formed on a free end of the Y-shaped throat (15), a handle formed on a free end of the shaft (12) and at least one slit (10) defined to receive an absorbing device (20) to absorb the reactive force generated when a ball is struck.

The shock-absorbing device (20) is provided to absorb the reactive force generated when the racket strikes a ball and to damp the resonant vibration in the racket after striking the ball to prevent the player's wrist from being injured. The shock-absorbing device (20) is made of a rubber-like material, such as TPR (5-polypentenamer rubber), PS (polystyrene) or a composite material combined with the TPR and the PS.

Figure 2:
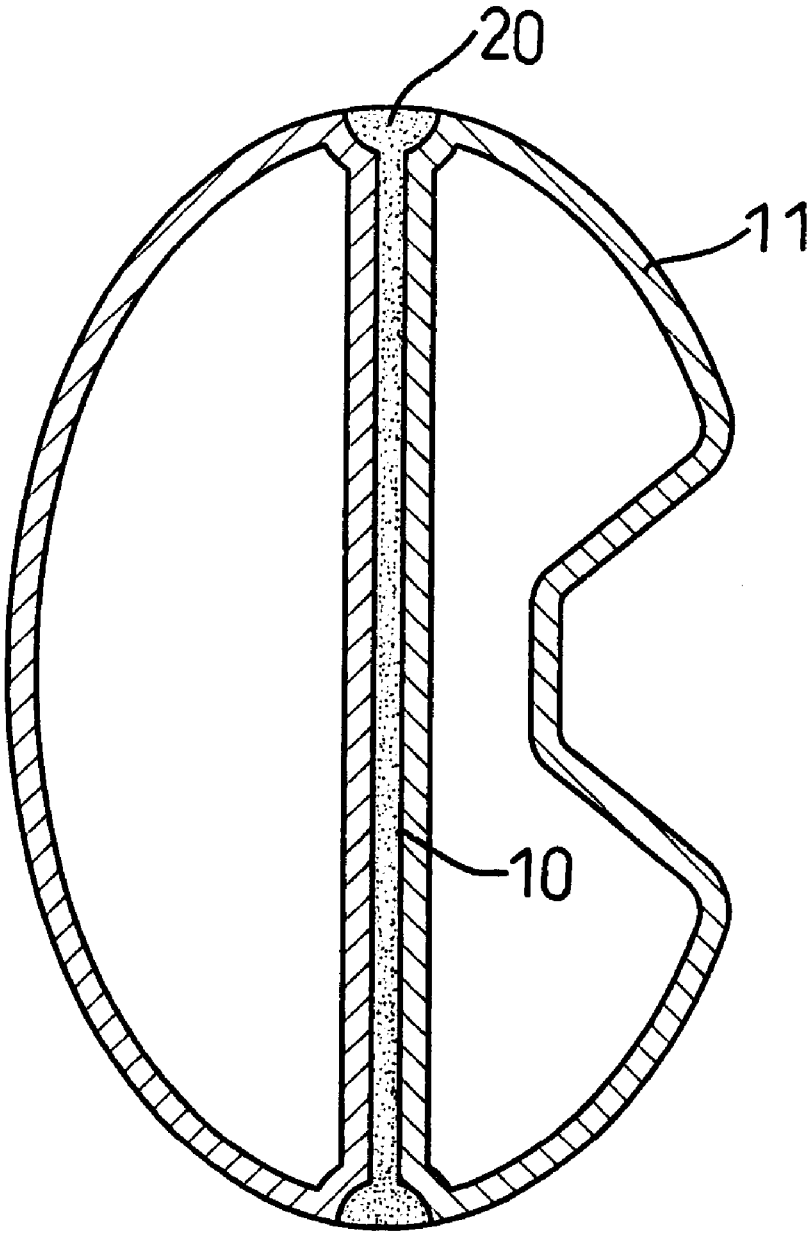
FIG. 2 is a cross sectional plan view of a frame of the shock-absorbing racket body along the line 2—2 in FIG. 1.

The shock-absorbing racket body in accordance with the present invention has multiple embodiments. With reference to FIGS. 1 and 2, a first embodiment of the shock-absorbing racket body in accordance with the present invention has the slit (10) laterally defined in the frame (11). The slit (10) extends through the frame (11) except in a section connected to the throat (15) of the racket. The throat (15) is integrally connected to the frame (1) in one plane.

Figure 3:
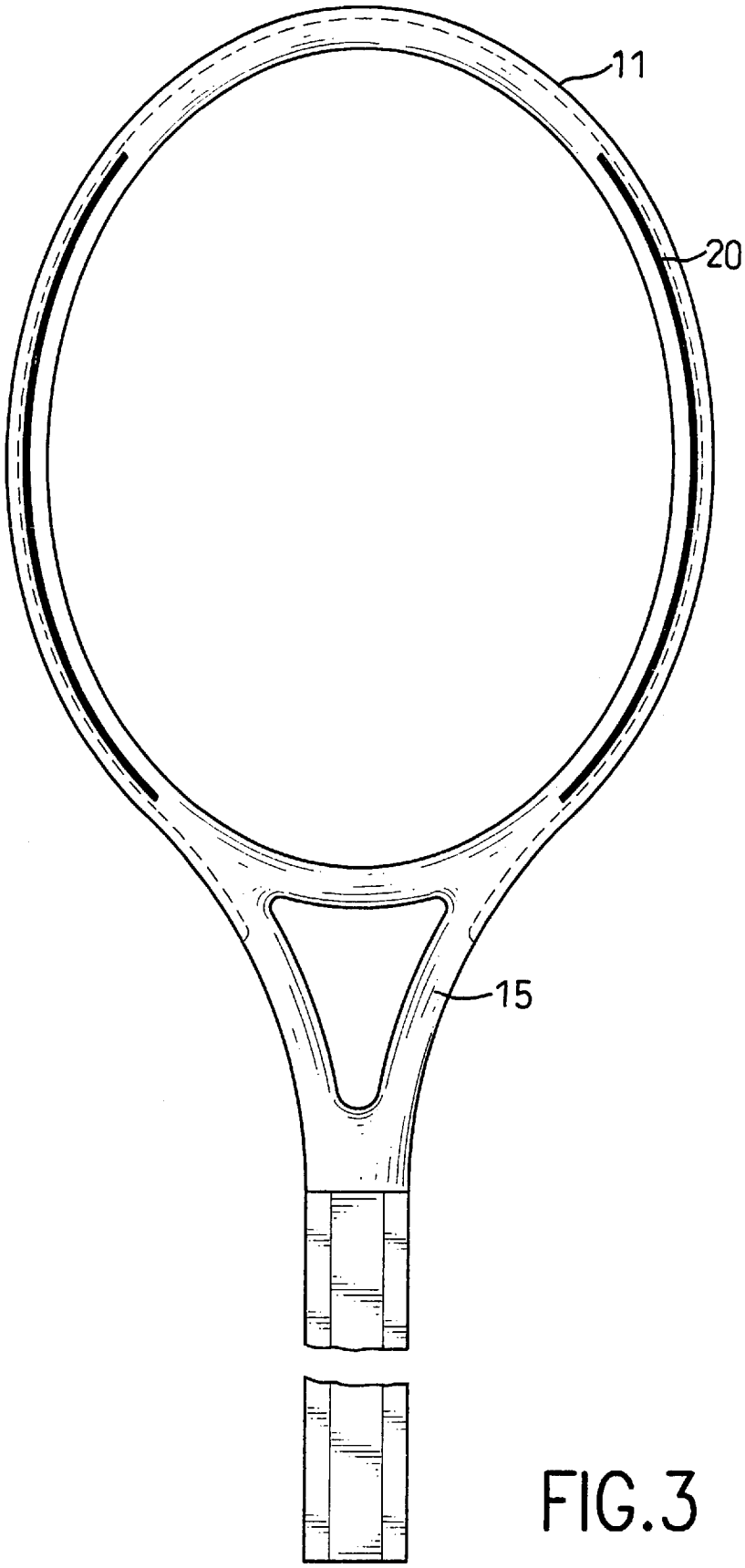
FIG. 3 is a front plan view of a second embodiment of the shock-absorbing racket body in accordance with the present invention.

With reference to FIG. 3, it is a second embodiment of the shock-absorbing racket body in accordance with the present invention. The slit (10) is laterally defined in and extending through the frame (11) except a top section of the frame (11) and the section connected to the throat (15).

Figure 4:
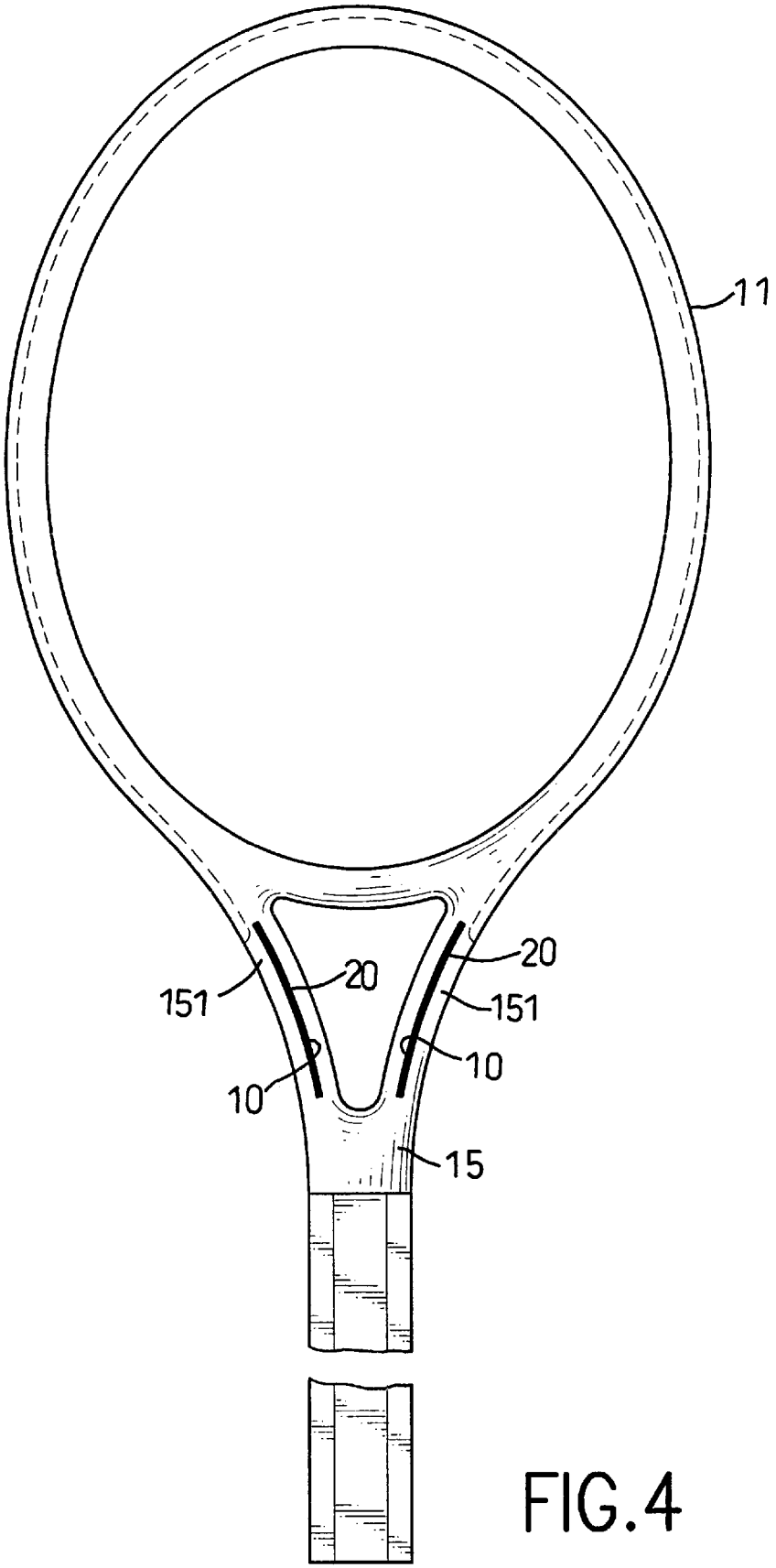
FIG. 4 is a front plan view of a third embodiment of the shock-absorbing racket body in accordance with the present invention.

With reference to FIG. 4, a third embodiment of the shock-absorbing racket body in accordance with the present invention has the Y-shaped throat (15) formed from two arms (151). Each arm (151) is integrally connected to the frame (11), and the slit (10) is laterally defined in and extends through each arm (151). The absorbing device (20) of the embodiment is mounted in each slit (10) in each arm (151) of the Y-shaped throat (15).

Figure 5:
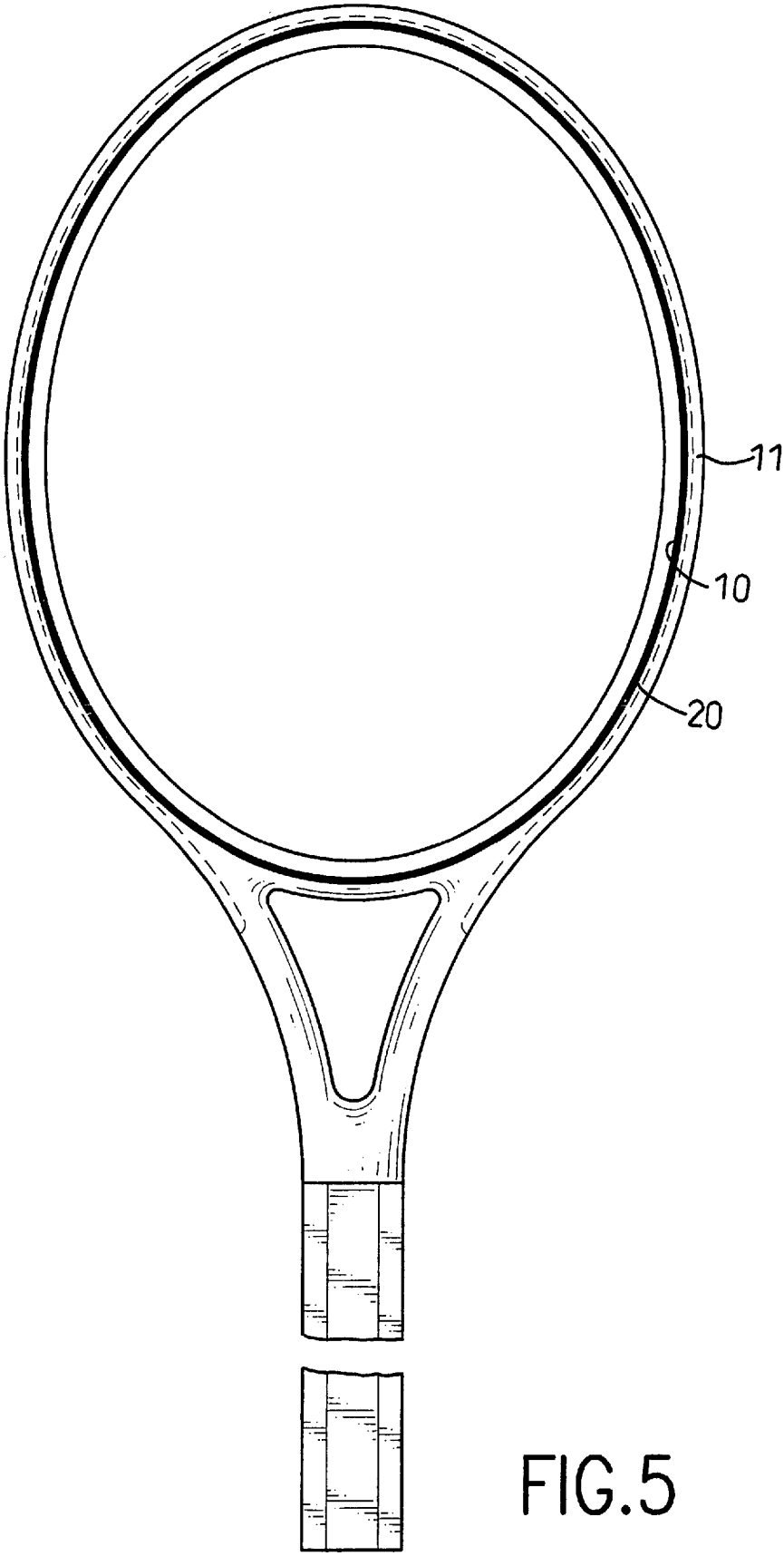
FIG. 5 is a front plan view of a fourth embodiment of the shock-absorbing racket body in accordance with the present invention.

With reference to FIG. 5, it is a fourth embodiment of the shock-absorbing racket body in accordance with the present invention. The slit (10) is laterally defined in and extending through the frame (11). The slit (10) is formed completely around the frame (11) and corresponds to the configuration of the frame (11).

Figure 6:
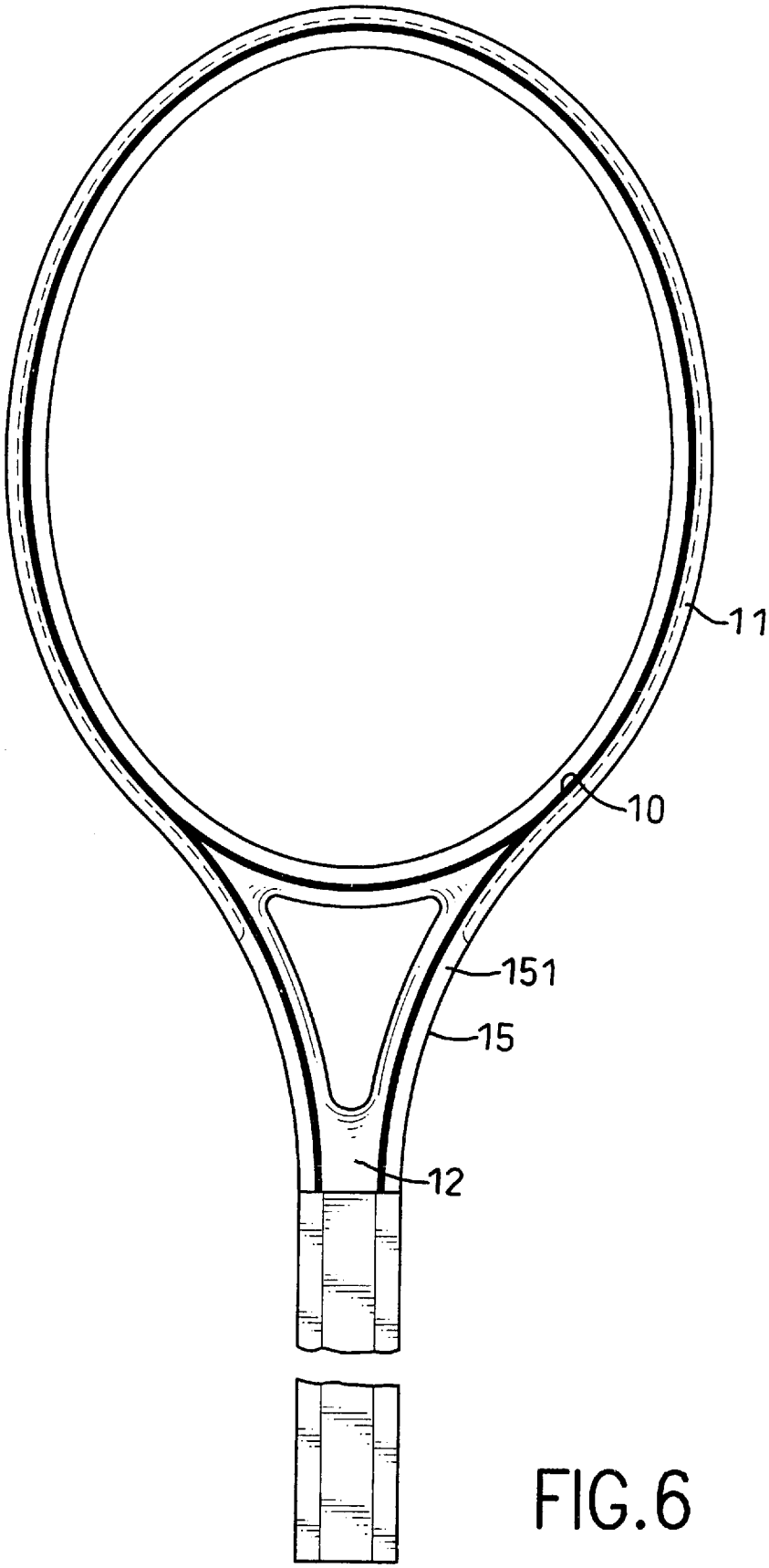
FIG. 6 is a front plan view of a fifth embodiment of the shock-absorbing racket body in accordance with the present invention.

With reference to FIG. 6, it is a fifth embodiment of the shock-absorbing racket body in accordance with the present invention. The slit (10) is defined in and laterally extending through the frame (11), two arms (151) of the Y-shaped throat (15) and two opposite sides of the shaft (12). The slits (11) in the frame (11), the two arms (151) of the Y-shaped throat (15) and the shaft (12) communicates with one another.

Figure 7:
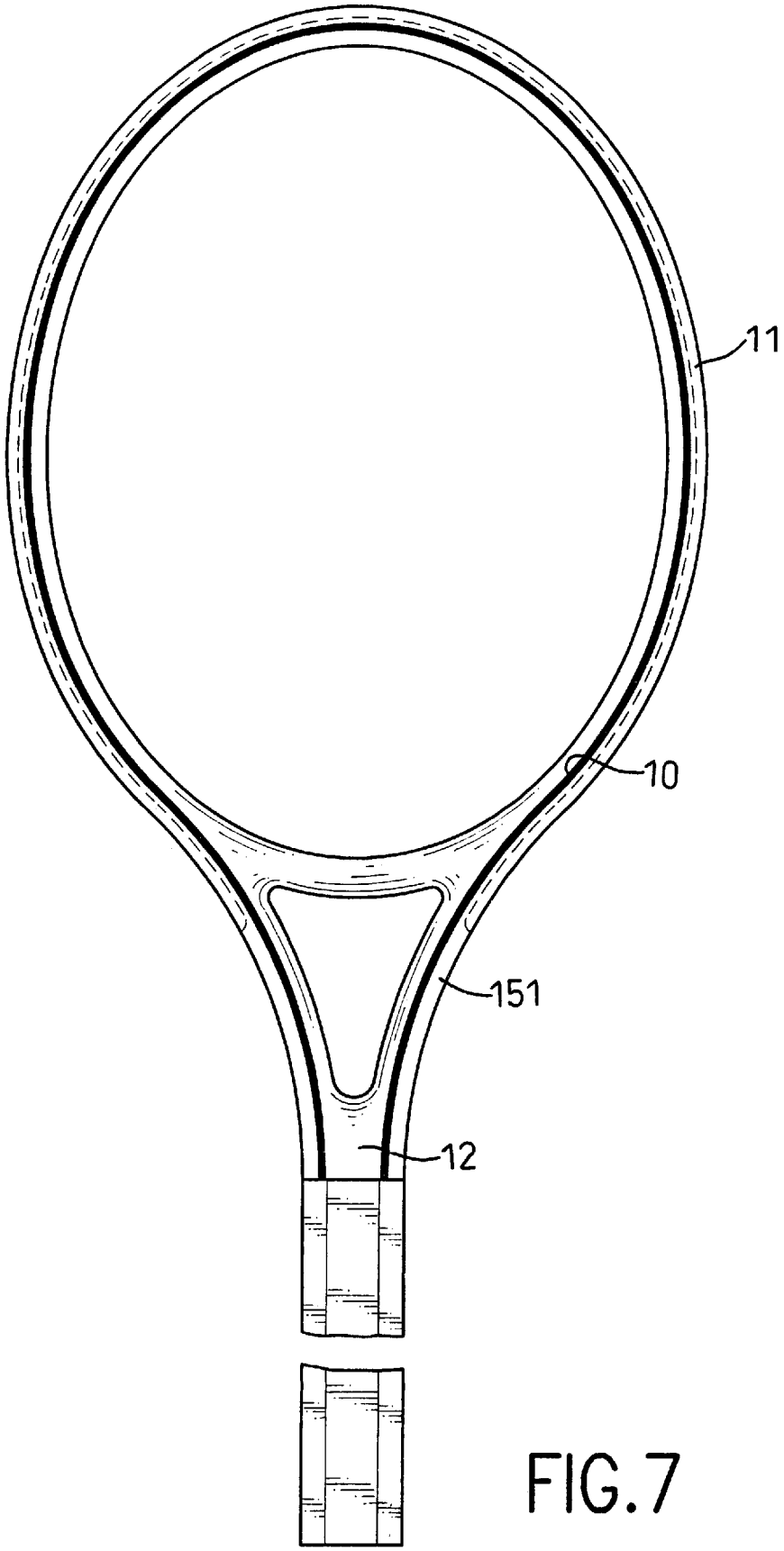
FIG. 7 is a front plan view of a sixth embodiment of the shock-absorbing racket body in accordance with the present invention.
Figure 8:
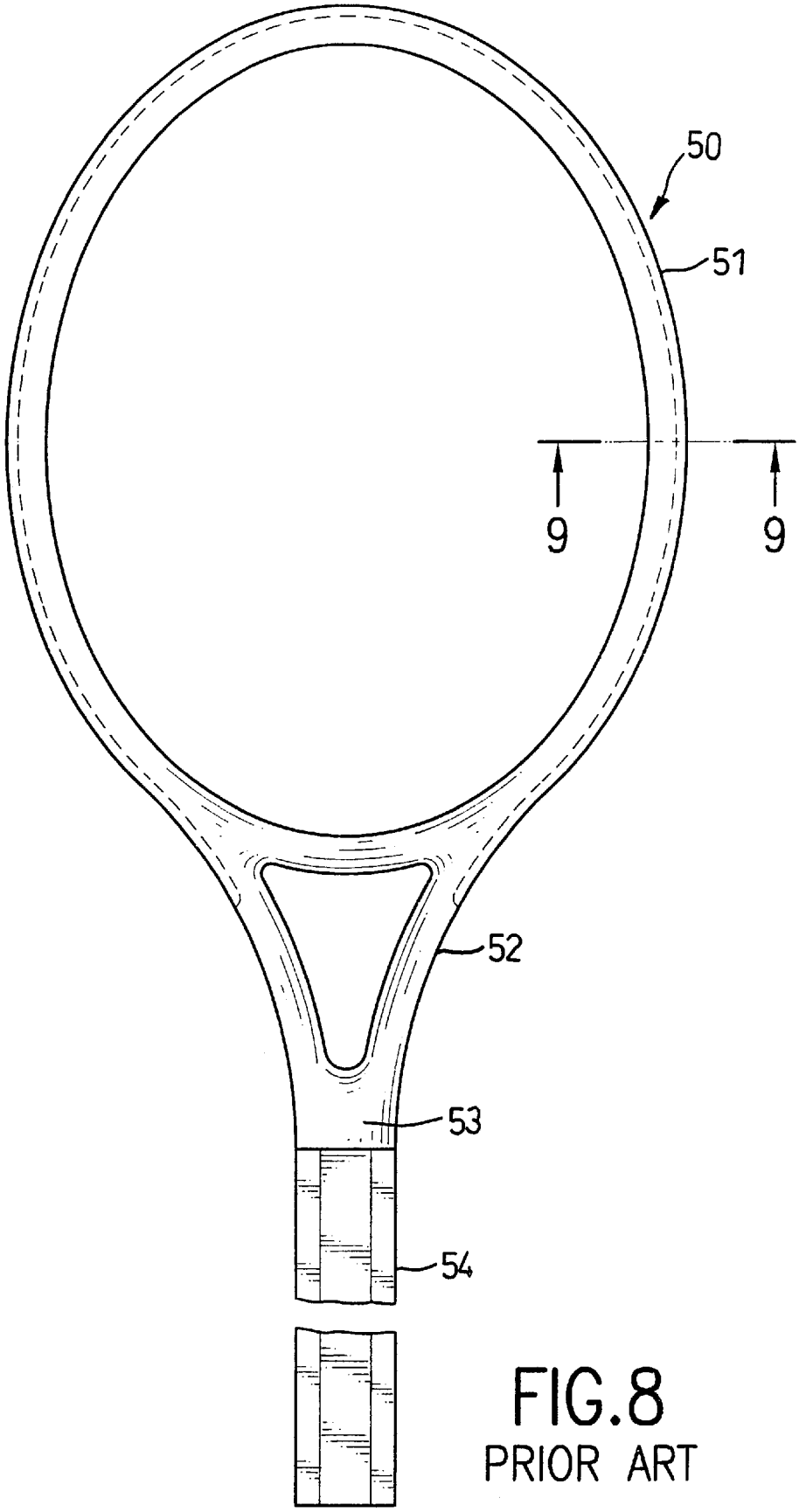
FIG.8 PRIOR ART
FIG. 8 is a front plan view of a conventional racket body in accordance with the prior art.
Figure 9:
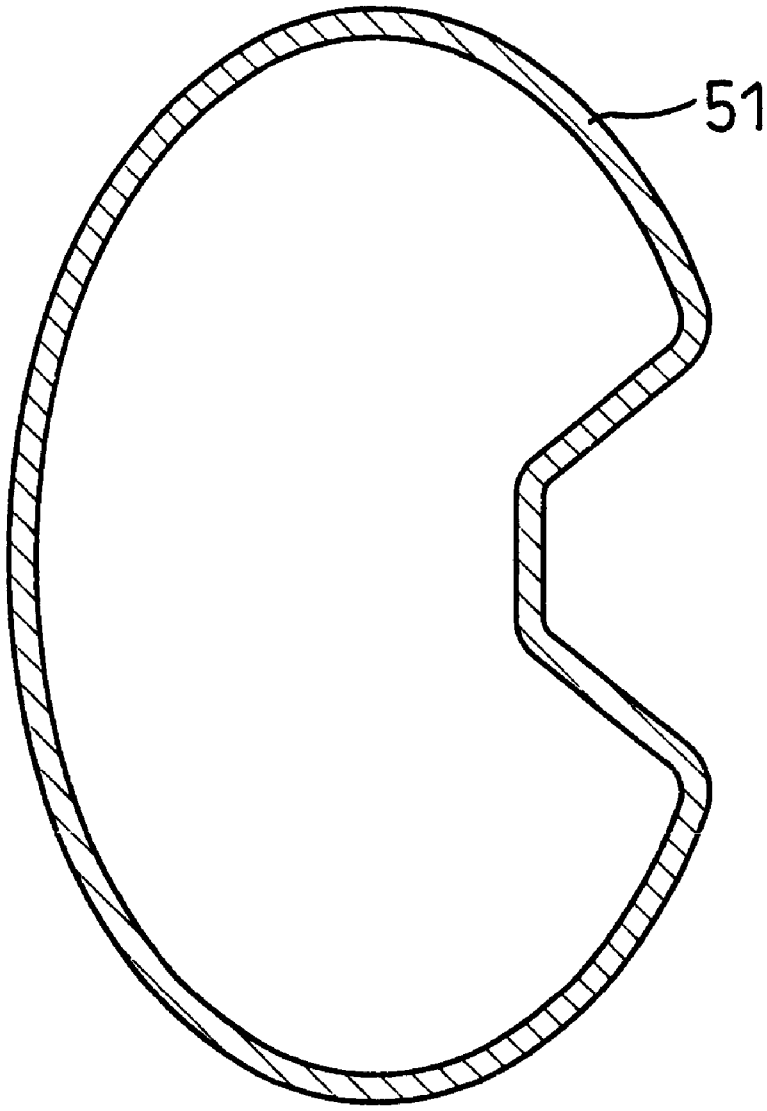
FIG.9 PRIOR ART
FIG. 9 is a cross sectional view of a frame of the conventional racket body along the line 9—9 in FIG. 8.

With reference to FIG. 7, it is a sixth embodiment of the shock-absorbing racket body in accordance with the present invention. The slit (10) is defined in and laterally extending through the frame (11), two arms (151) of the Y-shaped throat (15) and two opposite side of the shaft (12) except the section of the frame (11), which corresponds to the Y-shaped throat (15). The slits (11) in the frame (11), the two arms (151) of the Y-shaped throat (15) and the shaft (12) communicate with one another.

The absorbing device (20) can partially absorb the reactive force when the racket strikes a ball. Consequently, the initial resonant vibration is reduced and does not take as long to damp out. Consequently, the player's wrist is much less susceptible to injury because the reactive force generated when striking a ball and the resonant vibration of the racket after striking the ball are effectively reduced.

Although the invention has been explained in relation to its preferred embodiment, it is to be understood that many other possible modifications and variations can be made without departing from the spirit and scope of the invention as hereinafter claimed.

What is claimed is:

1. A shock-absorbing racket body comprising an elliptical frame, a Y-shaped throat integrally connected to the elliptical frame, a shaft integrally formed on a free end of the Y-shaped throat, a handle formed on a free end of the shaft and at least one slit defined to receive an absorbing device to absorb the reactive force generated when a ball is struck;

wherein the slit is laterally defined in and extends through the elliptical frame corresponding to a configuration of the elliptical frame except a section connected to the Y-shaped throat.

2. The shock-absorbing racket body as claimed in claim 1 wherein the slit is laterally defined in and extends through the elliptical frame corresponding to a configuration of the elliptical frame except a top section of the elliptical frame and a section connected to the Y-shaped throat.

3. The shock-absorbing racket body as claimed in claim 1 where the Y-shaped throat is formed from two arms respectively integrally connected to the elliptical frame on one plan, each arm of the Y-shaped throat has a slit defined to receive the shock-absorbing device.

4. The shock-absorbing racket body as claimed in claim 1 where the Y-shaped throat is formed from two arms respectively integrally connected to the elliptical frame and the shaft, wherein the elliptical frame, the Y-shaped throat and the shaft are in one plane, the slit is defined in and laterally extends through the frame corresponding to the configuration of the elliptical frame, the two arms of the Y-shaped throat and two opposite sides of the shaft, and the slits in the elliptical frame, the Y-shaped throat and the shaft communicate with one another.

5. A shock-absorbing racket body comprising an elliptical frame, a Y-shaped throat integrally connected to the elliptical frame, a shaft integrally formed on a free end of the Y-shaped throat, a handle formed on a free end of the shaft and at least one slit defined to receive an absorbing device to absorb the reactive force generated when a ball is struck;

wherein the slit is laterally defined in and extends through the elliptical frame corresponding to a configuration of the elliptical frame except a top section of the elliptical frame and a section connected to the Y-shaped throat.

6. The shock-absorbing racket body as claimed in claim 5 where the Y-shaped throat is formed from two arms respectively integrally connected to the elliptical frame on one plane, each arm of the Y-shaped throat has a slit defined to receive the shock-absorbing device.

7. The shock-absorbing racket body as claimed in claim 5 where the Y-shaped throat is formed from two arms respectively integrally connected to the elliptical frame and the shaft, wherein the elliptical frame, the Y-shaped throat and the shaft are in one plane, the slit is defined in an laterally extends through the frame corresponding to the configuration of the elliptical frame, the two arms of the Y-shaped throat and two opposite sides of the shaft, and the slits in the elliptical frame, the Y-shaped throat and the shaft communicate with one another.

8. The shock-absorbing racket body as claimed in claim 5 where the Y-shaped throat is formed from two arms respectively integrally connected to the elliptical frame and the shaft, wherein the elliptical frame, the Y-shaped throat and the shaft are in one plane, the slit is defined in and laterally extends through the frame corresponding to the configuration of the elliptical frame except a section corresponding to the Y-shaped throat, the two arms of the Y-shaped throat and two opposite sides of the shaft, the slit in the arms of the Y-shaped throat have two opposite ends respectively communicating with the slit in the frame and the slit in the shaft.

* * * * *